United States Patent [19]

French et al.

[11] Patent Number: 4,568,128

[45] Date of Patent: Feb. 4, 1986

[54] ROTARY CUTTER HEADS FOR MINERAL MINING MACHINES

[75] Inventors: Albert G. French, Willington; Derek J. Brooks, Ashby-de-la-Zouch, both of England

[73] Assignee: Coal Industry (Patents) Ltd., London, England

[21] Appl. No.: 539,944

[22] Filed: Oct. 7, 1983

[30] Foreign Application Priority Data

Jan. 11, 1983 [GB] United Kingdom ..... 8300664

[51] Int. Cl.[4] ..... E21C 35/22; E21F 1/00; E21B 10/60

[52] U.S. Cl. ..... 299/81; 299/42

[58] Field of Search ..... 299/81, 42, 53, 54

[56] References Cited

U.S. PATENT DOCUMENTS

| | | | |
|---|---|---|---|
| 3,843,199 | 10/1974 | Nash et al. | 299/81 |
| 3,904,246 | 9/1975 | Gandy et al. | 299/81 |
| 3,954,302 | 5/1976 | Browning | 299/81 |
| 4,411,475 | 10/1983 | Best et al. | 299/81 |
| 4,428,619 | 1/1984 | Eagles et al. | 299/81 |
| 4,465,318 | 8/1984 | Lewis et al. | 299/81 x |
| 4,501,449 | 2/1985 | Eagles | 299/81 |
| 4,516,807 | 5/1985 | Eagles | 299/81 X |
| 4,521,058 | 6/1985 | Eagles et al. | 299/81 |

FOREIGN PATENT DOCUMENTS

| | | | |
|---|---|---|---|
| 2062725 | 5/1981 | United Kingdom | 299/81 |

*Primary Examiner*—James A. Leppink
*Assistant Examiner*—Michael A. Goodwin
*Attorney, Agent, or Firm*—Stevens, Davis, Miller & Mosher

[57] ABSTRACT

A rotary cutter head for a mining machine is provided with a plurality of cutter tools mounted on an annular end component which defines the end of the cutter head remote from the mining machine. Ventilating means are provided comprising air flow guide passages having air flow inducing spray means, the air flow inlets to the guide passages being in an exposed zone in which the action of cut mineral and/or of the newly exposed working face tends to scour the inlets preventing the build up of damp, fine mineral particles and thereby tending to prevent blockage of the inlets.

8 Claims, 2 Drawing Figures

ROTARY CUTTER HEADS FOR MINERAL MINING MACHINES

Figure 1:
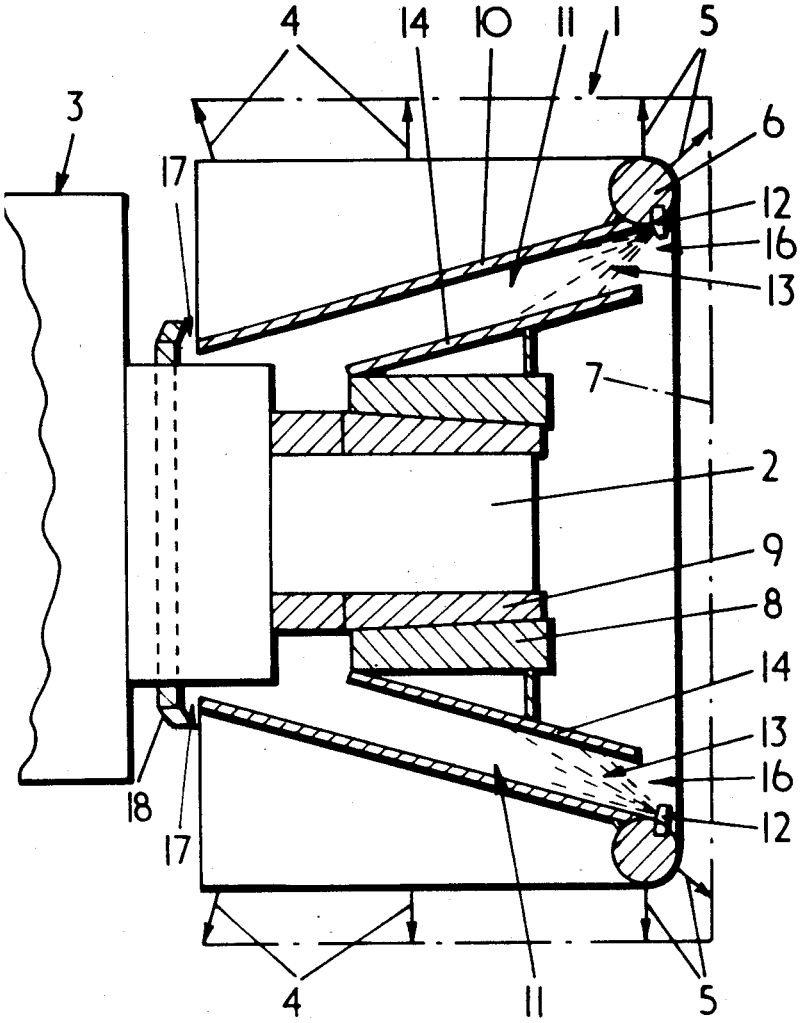

This invention relates to rotary cutter heads for mineral mining machines, the cutter heads being drivably mountable on rotary drive units of the machines and having cutter tools mounted around their outer peripheries for breaking mineral from working faces. In addition, cutter tools are arranged around the rims of the cutter heads to cut mineral relatively remote from the mining machines to form upright newly exposed working faces.

Frequently, when such a cutter head is used to break coal from a longwall coal face there is a tendency for methane emitted from the broken coal to concentrate around the cutter head which is operating in a buttock shielded from the main ventilation air flow. Such a concentration of methane is potentially dangerous, especially if the methane is allowed to collect in the vicinity of the cutting zone of the cutter head until its concentration is within the explosive range ie 8% to 15% of methane. Once the concentration of methane is within this range it is possible for a spark generated by a cutter tool striking an intrusion in the coal face to ignite the methane which in turn could give rise to an explosion. In addition, the winning of coal tends to generate dust including respirable dust which if not controlled can find its way into the main ventilation air flow in the mine. In order to try to combat the above problem it is known for a rotary cutter to comprise ventilating means remote from the axis of rotation of the cutter and including at least one air flow guide provided with a nozzle for directing fluid along the guide to induce air flow therealong. Unfortunately, in use, the inlet to the air flow guide tends to become blocked with damp fine mineral particles. Such an occurrence can give rise to inefficient ventilation of the cutter head and reduced collection efficiency of respirable dust.

An object of the present invention is to provide an improved cutter head for a mineral mining machine which tends to overcome or reduce the above mentioned problem.

According to the present invention a rotary cutter head for a mineral mining machine having a drive unit extending towards the working mineral face, comprises a hub assembly drivably mountable on the drive unit of the machine, a barrel component secured around the hub assembly, a plurality of cutter tool holders provided around the periphery of the cutter head and around an annular end component which in use defines the end of the cutter head remote from the mining machine, and ventilating means mounted between the hub assembly and the barrel component and including at least one air flow guide and spray means for diverting an air flow inducing spray along the air flow guide, the air flow guide having an air flow inlet adjacent to the radially innermost portion of the end component such that in use, the inlet is in an exposed zone in which the action of cut mineral and/or of the newly exposed working face tends to scour the inlet preventing the build up of damp, fine mineral particles and thereby tends to prevent blockage of the inlet.

Preferably, the spray means comprises at least one nozzle mounted on the end component.

Advantageously, the or each air flow guide is generally rectangular in cross-section.

Conveniently, at least a portion of the barrel component comprises the radially outermost wall of each air flow guide.

Preferably, the barrel component is generally of hollow frusto-conical form.

Preferably, the or each air flow guide is inclined radially inward in an axial direction away from the end component.

Preferably, the or each air flow guide comprises an air flow outlet between the hub assembly and the barrel component.

Preferably, an air flow deflector is provided tending to urge at least a portion of the air flow discharging from the or each air flow outlet towards the periphery of the cutter head.

Figure 2:
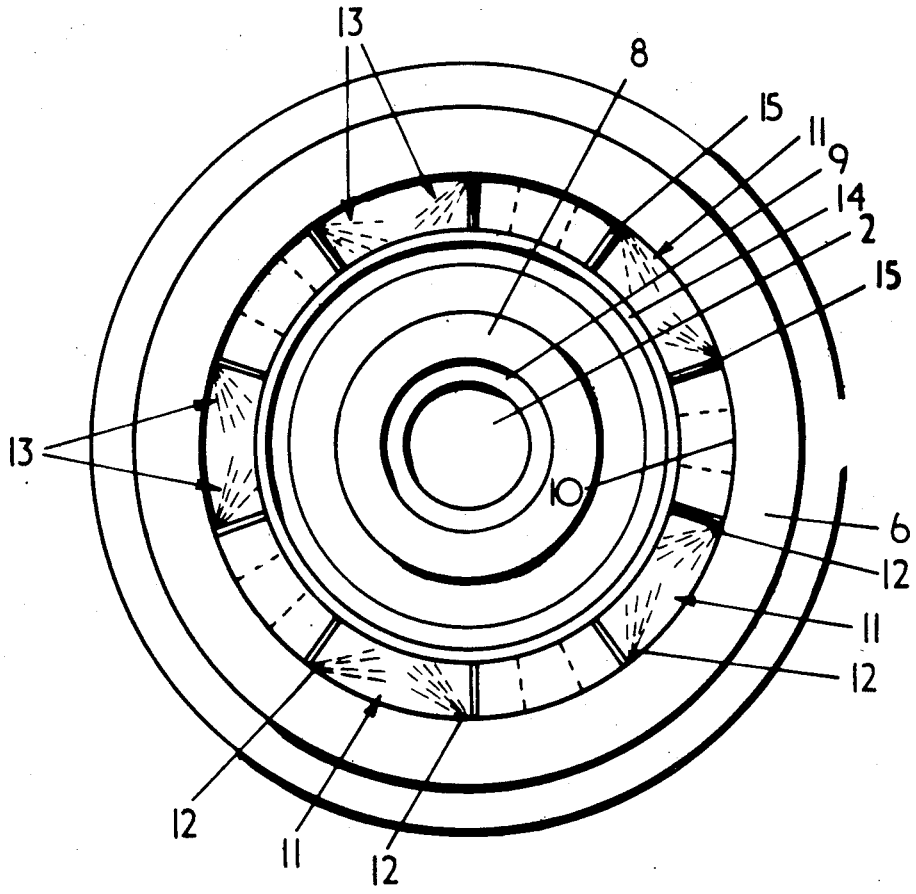

By way of example, one embodiment of the present invention will be described with reference to the accompanying drawings, in which:

FIG. 1 is a diagrammatic sectional view of a rotary cutter head for a mining machine, the section being taken through the axis of rotation of the head; and FIG. 2 is an incomplete end view of FIG. 1.

The drawings show a rotary cutter head 1 drivably mounted on a driven shaft 2 of a coal mining machine 3 (only the outline of a portion of which is shown) of the well known "shearer" type. In operation such a shearer machine traverses to and fro along a longwall coal face with cutter tools 4 (indicated by longitudinal axes only) mounted in tool holders (not shown) arranged around the periphery of the cutter head winning coal from the working face as the machine advances along the face. A plurality of the cutter tools 5 (omitted from FIG. 2) are mounted in tool holders (not shown) provided around an annular end component 6 which substantially defines the end of the cutter head 1 remote from the mining machine 3. As shown in FIG. 1 the end component 6 is ring shaped, having generally circular cross section.

The cut coal is loaded by means of helical loading vanes (not shown) on to an armoured face conveyor (not shown) which extends along the longwall face 7. As the cutter head 1 cuts the face 7, the cutter tools 4 form a buttock in the working face thereby tending to shield the cutter head 1 from the main ventilating air flow of the mine which is passing along the face 7. The cutter tools 5 on the end component 6 cut mineral relatively remote from the machine 3 thereby forming an upright newly exposed working face 7 which will be won on the next pass of the machine 3 along the face 7.

The cutter head 1 comprises a hub assembly 8 drivably mounted on the drive shaft 2 and retained in position by a key and spacer assembly 9. A hollow barrel component 10 of generally frusto conical form is secured around the hub assembly 8, the barrel component 10 constituting a mounting platform for the aforementioned helical loading vanes which in turn carry the tool holders for the cutter tools 4.

The cutter head 1 also comprises ventilating means mounted between the hub assembly 8 and the barrel component 10 and including a plurality of air flow guide passages 11 and spray means 12 for directing air flow inducing sprays 13 along the air flow guide passages 11 in a direction towards the mining machine. As seen in FIG. 2 each air flow guide passage 11 has a generally rectangular cross section with the outer wall constituted by the radially inwardly directed surface of the barrel component. Plates 14 and 15 define the innermost walls and side walls, respectively, of each guide passage 11. In the embodiment shown in FIG. 2 the spray means 12 includes two spray nozzles mounted adjacent the opposite side walls 15 of each guide passage 11.

As seen in FIG. 1 each air flow guide passage 11 is inclined radially inward in an axial direction away from the end component 6. Each guide passage 11 having an air flow inlet 16 adjacent to the radially innermost portion of the end component 6 such that in use, the inlet is in an exposed zone in which the action of cut mineral and/or of the newly exposed longwall face 7 tends to scour the inlet 16 preventing the build up of damp, fine mineral particles and thereby tends to prevent blockage of the inlet 16.

Each air flow guide passage 11 is provided with an air flow outlet 17 between the hub assembly and the barrel component 10. In addition, an air flow deflector 18 is provided tending to urge at least a portion of the air flow discharging from the air flow guide passage towards the periphery of the cutter head.

In use, as the mining machine traverses to and fro along the longwall face 7 the inlets 6 of the ventilating means tend to be maintained clear of blockage by the action of cut mineral and/or of the newly exposed coal face scouring the inlet.

We claim:

1. A rotary cutter head for a mineral mining machine having a drive shaft, comprising:

a hub assembly drivably mountable on the drive shaft of the machine;

a barrel component secured around the hub assembly;

a plurality of cutter tool holders provided around the periphery of the cutter head and around an annular end component which in use defines the end of the cutter head remote from the mining machine;

ventilating means mounted between the hub assembly and the barrel component and including a plurality of air flow guide passages;

each air flow guide passage having an open ended air flow inlet adjacent to the radially innermost portion of the end component and in direct unimpeded communication with the working face such that in use the inlet is in an exposed zone immediately adjacent to the working face so that the action of cut mineral and/or of the newly exposed working face scours the open ended inlet to prevent the build up of damp, fine mineral particles and thereby prevents blockage of the inlet;

spray means located at said inlet for directing an air flow inducing spray along each of the air flow guide passages.

2. A head as claimed in claim 1, in which the spray means comprises at least one nozzle mounted on the end component.

3. A head as claimed in claim 2, in which each air flow guide passage is generally rectangular in cross-section.

4. A head as claimed in claim 3, in which at least a portion of the barrel component comprises the radially outermost wall of each air flow guide passage.

5. A head as claimed in claim 1, in which the barrel component is generally of hollow frusto conical form.

6. A head as claimed in claim 1, in which each air flow guide passage is inclined radially inward in an axial direction away from the end component.

7. A head as claimed in claim 1, in which each air flow guide passage comprises an air flow outlet between the hub assembly and the barrel component.

8. A head as claimed in claim 7, in which an air flow deflector is provided tending to urge at least a portion of the air flow discharging from the air flow outlets towards the periphery of the cutter head.

* * * * *